US012575598B2

(12) United States Patent
Peña et al.

(10) Patent No.: US 12,575,598 B2
(45) Date of Patent: Mar. 17, 2026

(54) ROLLING PAPER AND METHODS OF MAKING SAME

(71) Applicant: SPLIFF ENTERPRISE LLC, Hialeah, FL (US)

(72) Inventors: Juan Peña, Hialeah, FL (US); Rafael Guzman, Miami Lakes, FL (US); Patrick Joint, Miami, FL (US); Luis Diaz, Canton, GA (US); Patrick Frett, Boca Raton, FL (US); Kenny Guzman, Miami Lakes, FL (US)

(73) Assignee: SPLIFF ENTERPRISE LLC, Hialeah, FL (US)

( * ) Notice: Subject to any disclaimer, the term of this patent is extended or adjusted under 35 U.S.C. 154(b) by 484 days.

(21) Appl. No.: 17/100,110

(22) Filed: Nov. 20, 2020

(65) Prior Publication Data

US 2022/0160022 A1 May 26, 2022

(51) Int. Cl.

| | |
|---|---|
| ***A24D 1/02*** | (2006.01) |
| ***A24D 1/18*** | (2006.01) |
| ***A24F 17/00*** | (2006.01) |

(52) U.S. Cl.

CPC ..... *A24D 1/025* (2013.01); *A24D 1/022* (2013.01); *A24D 1/18* (2013.01); *A24F 17/00* (2013.01)

(58) Field of Classification Search

CPC ..... A24D 1/02; A24D 1/022; A24D 1/025

See application file for complete search history.

(56) References Cited

U.S. PATENT DOCUMENTS

| | | | | |
|---|---|---|---|---|
| 3,385,302 | A * | 5/1968 | Wattenford | A24C 5/40 131/365 |
| 5,060,675 | A * | 10/1991 | Milford | A24D 1/02 131/365 |
| 5,121,758 | A * | 6/1992 | Schmekel | C09J 105/06 131/360 |
| 5,657,773 | A | 8/1997 | George | |
| 2005/0056294 | A1* | 3/2005 | Wanna | A24D 1/025 131/370 |
| 2007/0095359 | A1* | 5/2007 | Kang | B65D 77/003 131/365 |
| 2012/0006339 | A1* | 1/2012 | Sinclair, Jr. | A24D 1/002 131/107 |

(Continued)

FOREIGN PATENT DOCUMENTS

| | | | | |
|---|---|---|---|---|
| GB | 2492086 | A * | 12/2012 | A24D 1/02 |
| WO | WO-2012093166 | A1 * | 7/2012 | A24D 1/02 |

OTHER PUBLICATIONS

Podraza, Ken, "Basic Principles of Cigarette Design and Function," Philip Morris USA, Published Oct. 29, 2001, <http://www.lsro.org/presentation_files/air/m_011029/podraza_102901.pdf>. (Year: 2001).*

*Primary Examiner* — Philip Y Louie
*Assistant Examiner* — Sonny V Nguyen
(74) *Attorney, Agent, or Firm* — Ballard Spahr LLP

(57) ABSTRACT

A rolling paper assembly can comprise a paper having a length, a width, and first and second longitudinally extending edges spaced by the width and first and second ends spaced by the length. A quantity of tobacco can extend along at least a portion of the length of the paper. A first adhesive can bind the quantity of tobacco to the paper. A second adhesive can be configured to adhere a first portion of the paper to a second portion of the paper.

12 Claims, 3 Drawing Sheets

(56) References Cited

U.S. PATENT DOCUMENTS

| | | | | |
|---|---|---|---|---|
| 2013/0209753 | A1* | 8/2013 | Idheileh | B32B 29/005 428/194 |
| 2013/0313146 | A1* | 11/2013 | Idheileh | A24D 1/022 206/449 |
| 2014/0360519 | A1 | 12/2014 | George et al. | |
| 2020/0260781 | A1 | 8/2020 | Babi et al. | |
| 2020/0337365 | A1* | 10/2020 | Mendoza | A24B 9/00 |

* cited by examiner

ROLLING PAPER AND METHODS OF MAKING SAME

FIELD

The invention relates to smoking and, in particular, to papers for forming smokable rolled objects.

BACKGROUND

Individuals often smoke substances mixed with tobacco. For example, a conventional spliff comprises marijuana and tobacco that are mixed together and then rolled within a rolling paper. However, forming such a marijuana cigarette requires mixing the tobacco and marijuana, which can be messy and make it difficult to achieve desired proportions and uniform distribution. Another such rolled object for smoking a combination of cannabis and tobacco is a blunt, which includes marijuana rolled in a tobacco leaf (e.g., a cigar wrap). Blunt wrappers can use different types of tobacco leaves that are not preferable or desirable to all smokers. Additionally, blunts do not provide a preferable ratio of marijuana to tobacco for all smokers. That is, the tobacco overpowers and masks the flavor of the smokable substance (e.g., marijuana). Although this can be desirable for some smokers, many smokers desire the flavor of the marijuana, and the quantity of tobacco in the blunt inhibits this experience. Moreover, for blunts, tobacco leaves define the outer surface that contacts the lips of the smoker, which can be undesirable for various reasons, including smoker preferences. Additionally, the more tobacco that is included in a smokable rolled object, the more the smoker will suffer from the health risks associated with smoking tobacco. Thus, it can be desirable to limit the quantity of tobacco in such smokable rolled objects.

SUMMARY

Described herein, in various aspects, is a rolling paper assembly. The rolling paper assembly can comprise a paper having a length, a width, and first and second longitudinally extending edges spaced by the width and first and second ends spaced by the length. The paper can have a surface area. A quantity of tobacco can extend along at least a portion of the length of the paper. The quantity of tobacco can define a surface area that is less than the surface area of the paper. A first adhesive can bind the quantity of tobacco to the paper. A second adhesive can be configured to adhere a first portion of the paper to a second portion of the paper.

In another aspect, a cigarette can comprise an article comprising a paper having a length, a width, and first and second longitudinally extending edges spaced by the width and first and second ends spaced by the length. A quantity of tobacco can extend along at least a portion of the length of the paper. A first adhesive can bind the quantity of tobacco to the paper. A second adhesive can be configured to adhere a first portion of the paper to a second portion of the paper. The article can be in a roll and maintained in rolled form via the second adhesive with the quantity of tobacco disposed within the roll. A smokable substance can be disposed within the roll.

In another aspect, a kit can comprise a plurality of rolling papers having tobacco attached thereto. Each rolling paper of the plurality of rolling papers can have a surface area. The quantity of tobacco attached to each rolling paper can cover only a portion of the surface area of the paper.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
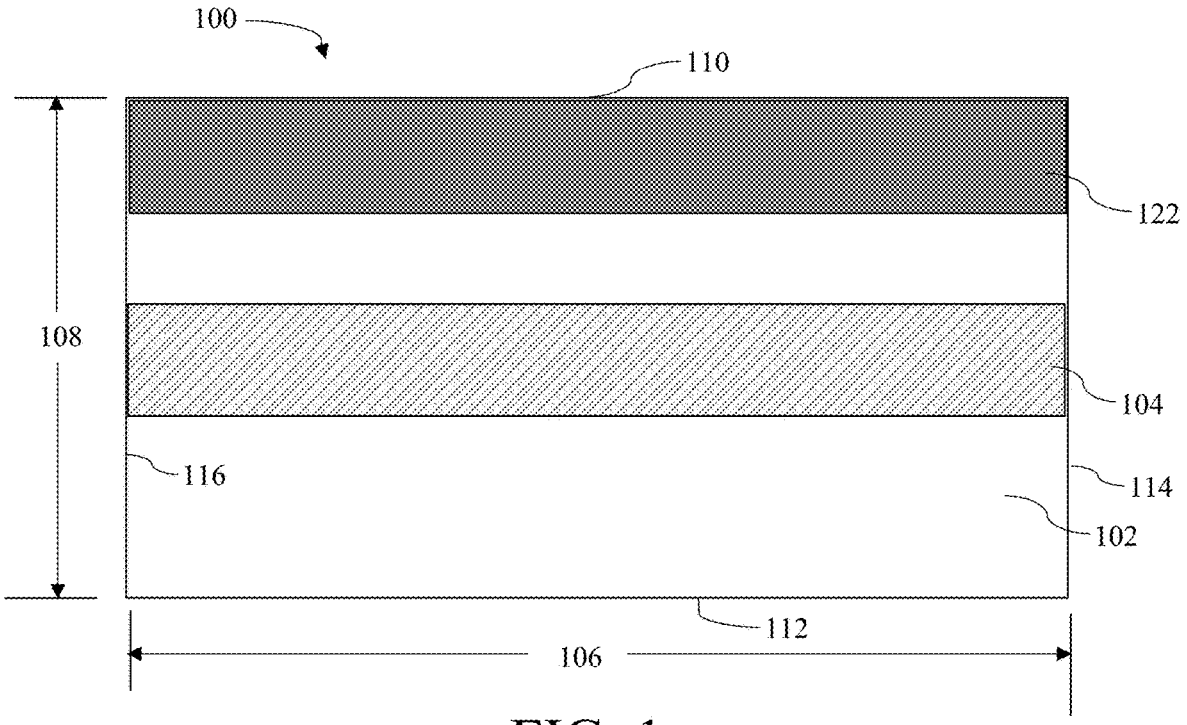
FIG. 1 is a top view of a rolling paper assembly in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms “a,” “an,” and “the” include plural referents unless the context clearly dictates otherwise. For example, use of the term “an adhesive” can refer to one or more of such adhesives, and so forth.

All technical and scientific terms used herein have the same meaning as commonly understood to one of ordinary skill in the art to which this invention belongs unless clearly indicated otherwise.

As used herein, the terms “optional” or “optionally” mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values or characteristics are approximated by use of the antecedents "about," "substantially," or "generally," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") to refer to the orientation of a surface should be understood to include embodiments in which angles are within about ten degrees, or within five degrees, or within one degree.

The word "or" as used herein means any one member of a particular list and also includes any combination of members of that list.

As used herein, except where otherwise indicated, it is understood that embodiments described or claimed using "comprise," "comprises," or "comprising" can alternatively be described or claimed using "consisting essentially of" or "consisting of" or equivalent terms.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

The term "cigarette," as used herein, should be understood to describe various types of rolled objects comprising a smokable substance (i.e., a substance that is capable of being smoked). That is, the smokable substance in a cigarette should not be limited only to tobacco. For example, the term "cigarette," as used herein, should be understood to encompass marijuana cigarettes, such as spliffs.

Disclosed herein, in various aspects and with reference to FIGS. 1-4, is a rolling paper assembly 100 comprising a rolling paper 102 having a quantity of tobacco 104 coupled (e.g., adhered) thereto or otherwise retained therein.

The rolling paper 102 can be a conventional rolling paper as is known in the art. Typically, such rolling papers are manufactured from wood pulp, hemp, flax, rice, straw, or like materials. In some aspects, rolling papers can be manufactured from homogenized paper, which can optionally be impregnated with selected materials. In preferred embodiments, the rolling paper 102 can be entirely (100%) derived from natural products. In a starting position (before rolling), the rolling paper can have a length 106 and a width 108. A first longitudinally extending edge 110 and a second longitudinally extending edge 112 can be spaced by the width 108. The rolling paper 102 can further have a first end 114 and a second end 116 that are spaced by the length 106 of the rolling paper. In various optional, exemplary aspects, the rolling paper can have dimensions of 70 mm by 32 mm, 77 mm by 44 mm, 110 mm by 44 mm, 100 mm by 53 mm, or 77 mm by 60 mm. Accordingly, in various optional aspects, the length can be between 70 mm and 110 mm, and the width can be between 32 mm and 60 mm. However, it is contemplated that these dimensions can be modified as necessary to account for differences in the quantity and/or type of smokable substances to be received within the rolling paper. The rolling paper 102 can have an inner side 118 and an opposing outer side 119. The inner side 118 can receive the smokable substance thereon. When rolled into a cigarette, at least a portion of the outer side 119 can form an exterior surface of the cigarette.

Figure 2:
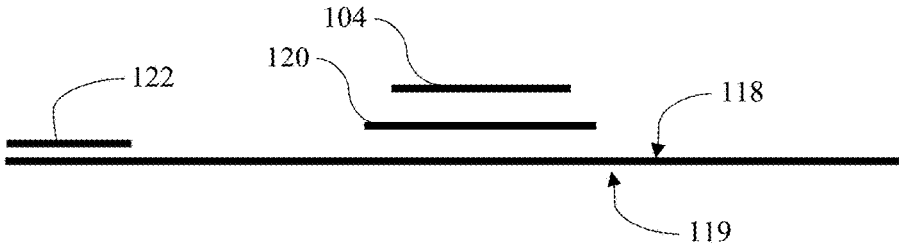
FIG. 2 is an exploded end view of the rolling paper assembly of FIG. 1.
Figure 3:
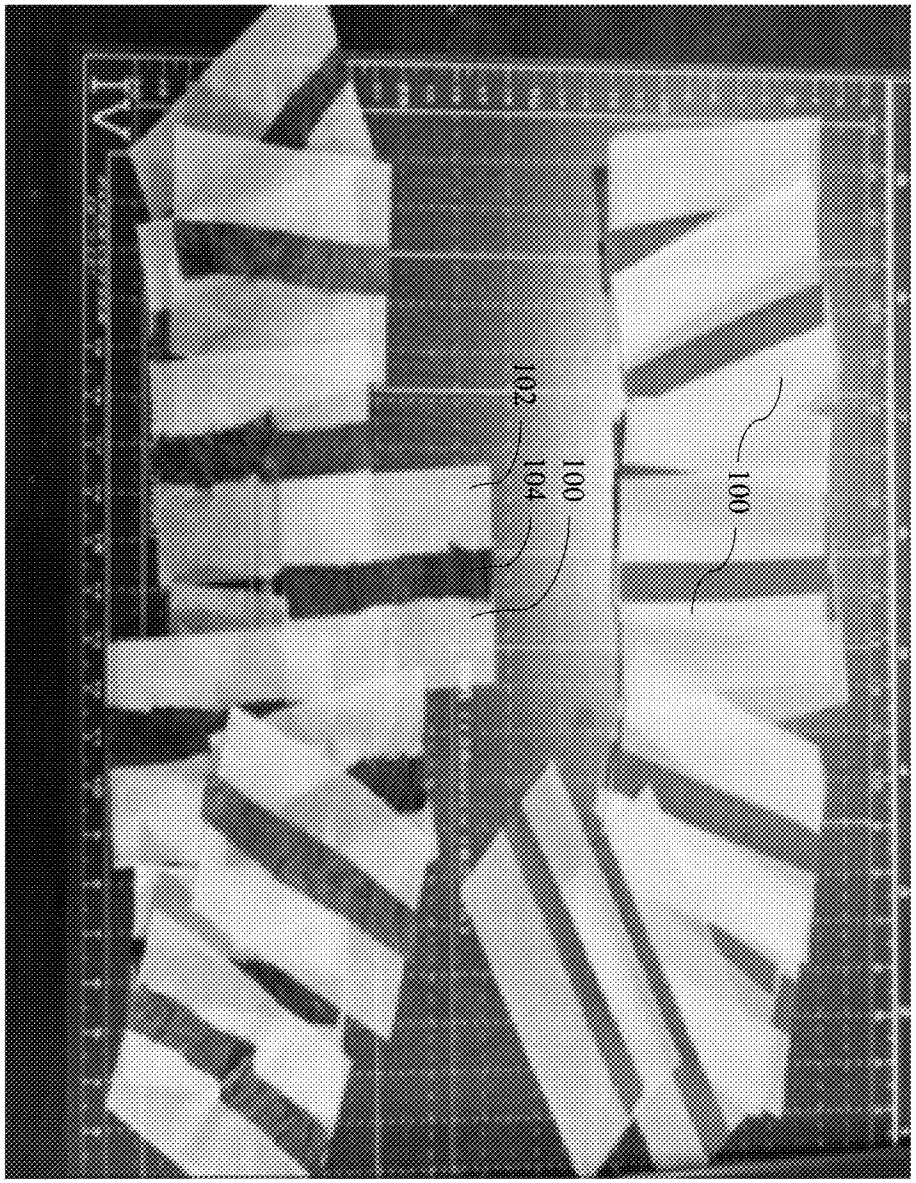
FIG. 3 is a top view of a plurality of exemplary rolling paper assemblies in accordance with embodiments disclosed herein.
Figure 4:
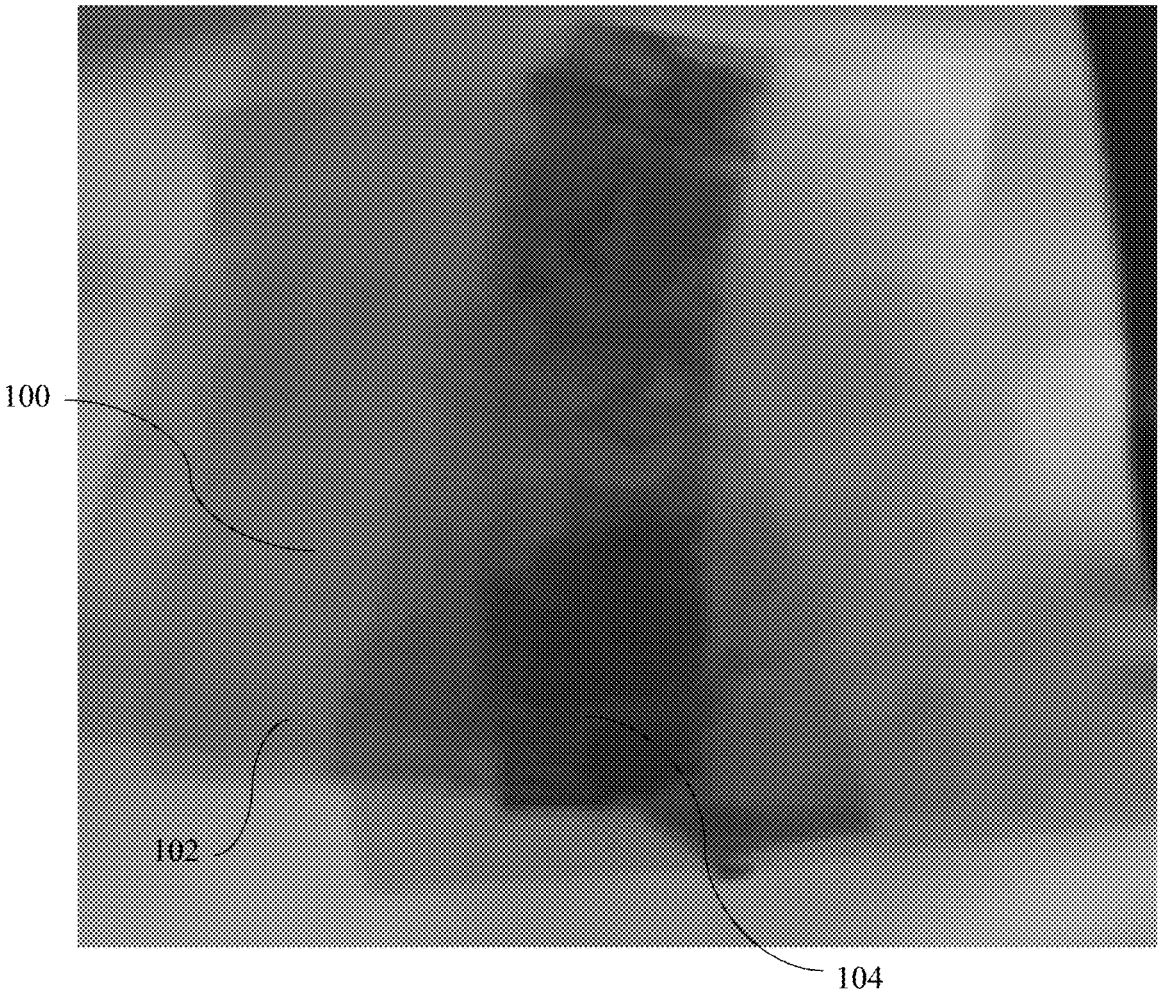
FIG. 4 is a top view of a stack of exemplary rolling paper assemblies in accordance with embodiments disclosed herein.

As shown in FIG. 2, a first adhesive 120 can bind the quantity of tobacco 104 to the rolling paper 102. It is contemplated that the first adhesive 120 can bind the quantity of tobacco 104 to the inner side 118 of the rolling paper 102. Optionally, the first adhesive can comprise or consist of sugar pectin (optionally all-natural sugar pectin). More generally, it is contemplated that the first adhesive can be a 100% naturally-derived and/or food-safe adhesive, such as, for example, gum, sugar-derived glues, or adhesives derived from cannabis oil or other plant-based oils. Optionally, in some aspects, the first adhesive 120 can be provided as a film, coating, or layer supplied directly to the rolling paper. Additionally or alternatively, it is contemplated that the first adhesive 120 can be provided as an adhesive strip. When not provided as a strip, it is contemplated that the layer of first adhesive can optionally consist of adhesive material, such as sugar pectin or other sugar-derived adhesives.

A second adhesive 122 can be configured to adhere the rolling paper 102 to itself so that the rolling paper assembly 100 can be formed and held in a roll. For example, when in rolled form, the second adhesive 122 can bind to a portion of the outer surface 119. The second adhesive 122 can optionally extend along the length of the roll and extend partially inwardly from one of the first or second longitudinally extending edges 110, 112. It is contemplated that the second adhesive 122 can be positioned on the inner side 118 of the rolling paper 102. Accordingly, it is contemplated that the second adhesive 122 can be positioned on the same side of the rolling paper 102 as the quantity of tobacco. In this way, when in rolled form, the quantity of tobacco 104 can be disposed within the rolling paper 102 (optionally, fully within the paper) so that the paper defines the entire outer surface of the cigarette. In this way, in contrast with, for example, a blunt, the quantity of tobacco 102 need not contact the lips of the user, which is preferable to many smokers.

Optionally, the second adhesive 122 can comprise sugar pectin (optionally, all-natural sugar pectin) or gum arabic.

More generally, it is contemplated that the second adhesive can be a 100% naturally-derived and/or food-safe adhesive, such as, for example, gum, sugar-derived glues, or adhesives derived from cannabis oil or other plant-based oils. Optionally, in some aspects, the second adhesive 122 can be provided as a film, coating, or layer supplied directly to the rolling paper. Additionally or alternatively, it is contemplated that the second adhesive 122 can be provided as an adhesive strip. When not provided as a strip, it is contemplated that the layer of second adhesive can optionally consist of adhesive material, such as sugar pectin or other sugar-derived adhesives. In some optional aspects, the second adhesive can optionally be water activated so that a user can lick or otherwise wet the adhesive to activate it for adhering one portion of the paper to itself. Such adhesives are well-known and ubiquitous in the art of rolling papers.

The first and second adhesives 120, 122 can be safe for inhalation after and during combustion.

In various aspects, the quantity of tobacco 104 can comprise or consist of whole leaf tobacco. The whole leaf tobacco can be cut into strips so that the width of the quantity of tobacco 104 is consistent along the length of the rolling paper assembly. It is contemplated that the tobacco can comprise or consist of natural whole leaf tobacco. In further aspects, the quantity of tobacco can comprise or consist of shredded tobacco. In various aspects, the quantity of tobacco can optionally comprise or consist of Fronto leaf. In further optional, non-limiting aspects, the tobacco can comprise or consist of Fanta leaf, Franta leaf, Funta leaf, Frunta leaf, Grabba leaf, Hot Grabba leaf, Funnels, Red Rose, Red Herring, or combinations thereof, or any suitable tobacco leaf. It is contemplated that different types of tobacco can be used to provide different smoker experiences. For example, some rolling paper assemblies 100 can comprise a first type of tobacco (e.g., a lighter leaf tobacco), whereas other rolling paper assemblies can comprise a second type of tobacco (e.g., darker leaf tobacco) that is different than the first type of tobacco.

In various optional aspects, the quantity of tobacco 104 can comprise or consist of a strip of tobacco having a thickness of a single tobacco leaf. In further optional aspects, the thickness of the quantity of tobacco 104 can be greater than a single tobacco leaf. The quantity of tobacco 104 can optionally have a width (transverse to the length 106 of the rolling paper 102) of less than one half inch, or less than one inch, or between ½ inch and one inch, or between one inch and 1-½ inch, or between 1-½ inch and 2 inches, or more than 2 inches. In various optional aspects, the width of the quantity of tobacco can be between 5% and 80%, between 10% and 50%, or between 10% and 35% of the width of the rolling paper 102. Accordingly, as is preferable to many smokers, in contrast to the quantity of tobacco in a blunt, the quantity of tobacco of the rolling paper assembly 100 can provide a tobacco experience (e.g., a sensation caused by nicotine from the tobacco) without overpowering or masking the flavor or other experience of the smokable substance within the rolling paper assembly 100. It is further contemplated that the disclosed quantity of tobacco can be limited (in particular, limited relative to a blunt) to reduce the negative health consequences of smoking tobacco. Optionally, the quantity of tobacco can have the width of the whole-leaf tobacco, or substantially the same width as the whole leaf tobacco (e.g., within 10% greater or less than the width of the whole leaf tobacco). The width of the quantity of tobacco 104 can optionally be consistent along the length 106 of the rolling paper 102. Alternatively, it is contemplated that the width of the quantity of tobacco 104 can vary along the length 106 of the rolling paper 102. For example, it is contemplated that the width of the quantity of tobacco 104 at or proximate a first end 114 can be greater or less than the width of the tobacco at or proximate the opposing second end 116.

In some optional aspects, the quantity of tobacco 104 can extend along an entire length of the rolling paper. In further aspects, the quantity of tobacco can extend along only a portion of the length of the rolling paper. For example, the quantity of tobacco 104 can extend from the first end 114 and continue along only a portion of the length of the rolling paper (for example, between 40% and 90% or between 50% and 70% of the length of the rolling paper).

It is thus contemplated that the quantity of tobacco 104 can have a surface area that is less than the surface area of the rolling paper. For example, the surface area of the quantity of tobacco can be between 5% and 80%, between 10% and 50%, or between 10% and 35% of the surface area of the rolling paper 102.

In some optional aspects, the quantity of tobacco 104 can be centered along the width of the rolling paper 102 (between the first and second longitudinally extending edges 110,112). In further aspects, the quantity of tobacco can be offset toward the first longitudinally extending edge 110 or offset toward the second longitudinally extending edge 112.

In various aspects, the rolling paper assembly 100 can consist of, or consist essentially of, the rolling paper 102, the quantity of tobacco 104, the first adhesive 120, and the second adhesive 122.

In various aspects, a kit can comprise a plurality of rolling papers having tobacco attached thereto (e.g., a plurality of rolling paper assemblies 100, as disclosed herein). The kit can further comprise packaging, such as, for example, a box, a wrapper, a container (e.g., comprising paper, polymer, or metal), or any other suitable packaging for housing the plurality of rolling papers having tobacco attached thereto. The rolling papers having tobacco attached thereto can be provided in the packaging in an unrolled (optionally, flat) configuration. In some optional aspects, the tobacco attached to a first rolling paper of the plurality of rolling papers can be the same type of tobacco as the tobacco that is attached to every other rolling paper of the plurality of rolling papers. In further optional aspects, the tobacco attached to a first rolling paper of the plurality of rolling papers can be a different type of tobacco (e.g., a lighter or darker leaf) than the tobacco attached to a second rolling paper of the plurality of rolling papers. In still further optional aspects, the tobacco attached to a first rolling paper of the plurality of rolling papers can have a quantity of tobacco (e.g., a strip of tobacco) that is less than or greater than (e.g., with a different surface area and/or different thickness than) a quantity of tobacco of a second rolling paper of the plurality of rolling papers. Optionally, in these aspects, it is contemplated that a system or kit can comprise a plurality of groups of rolling papers, with each group of rolling papers positioned in respective packaging based upon the quantity of tobacco associated with the rolling paper (e.g., "light tobacco," "medium tobacco," etc.).

The rolling paper assembly 100 can be used to form a cigarette (or other rolled smokable object). In various aspects, the cigarette can optionally comprise at least one smokable substance in addition to the quantity of tobacco that was provided as a component of the rolling paper assembly (prior to rolling). In these aspects, it is contemplated that the at least one smokable substance in addition to the tobacco can comprise cannabis or a product extracted or derived from the Cannabis plant, including for example and without limitation, ground cannabis, particles of cannabis stems, seeds, and/or leaves, hemp, hashish (hash), or combinations thereof. Accordingly, in some aspects, the rolling paper assembly 100 can be used to form a spliff. The cigarette can be rolled and held together in rolled form via the second adhesive 122. Optionally, it is contemplated that the cigarette can consist of the rolling paper assembly and the at least one smokable substance in addition to the quantity of tobacco. Alternatively, it is contemplated that various coating or oils (e.g., cannabis-derived oils) can be applied to the rolling paper assembly 100 during the assembly of the cigarette.

The rolling paper assembly 100 as disclosed herein can advantageously provide the spliff or other cigarette with a select amount of tobacco that is securely coupled to or associated with the rolling paper. Further, the rolling paper assembly 100 can provide a uniform (or other desired) distribution of tobacco along the length (or the smokable length) of the cigarette as opposed, to, for example, a hand-mixed spliff. Still further, the rolling paper assembly 100 can more easily allow formation of a cigarette without the difficulty of working with loose tobacco. Still further, the rolling paper can provide an all-natural product that easily allows for combining the smoking of tobacco with other smokable substances. Still further, as explained herein, the predetermined quantity of tobacco associated with the rolling paper can provide a tobacco experience without overpowering the taste and experience associated with the other smokable substance(s) that included in the spliff or other cigarette.

Although the foregoing invention has been described in some detail by way of illustration and example for purposes of clarity of understanding, certain changes and modifications may be practiced within the scope of the appended claims.

What is claimed is:

1. An article comprising:

a paper having a length, a width, first and second longitudinally extending edges spaced by the width, and first and second ends spaced by the length and extending between the first and second longitudinally extending edges, wherein the length of the paper is greater than the width of the paper, wherein the paper has a surface area, wherein the paper comprises at least one of wood pulp, hemp, flax, rice, or straw;

a quantity of tobacco extending along an entirety of the length of the paper from the first end to the second end of the paper, wherein the quantity of tobacco defines a surface area that is between 10% and 50% of the surface area of the paper, and wherein the quantity of tobacco comprises whole leaf tobacco;

a first adhesive that binds the quantity of tobacco to the paper; and a second adhesive that is configured to adhere a first portion of the paper to a second portion of the paper.

2. The article of claim 1, wherein the whole leaf tobacco is cut to have a uniform width transverse to the length of the paper.

3. The article of claim 1, wherein the quantity of tobacco comprises a single layer of whole leaf tobacco.

4. The article of claim 1, wherein the first adhesive comprises sugar pectin.

5. The article of claim 1, wherein the second adhesive comprises sugar pectin.

6. The article of claim 1, wherein the paper has a first side and an opposing second side, wherein the quantity of tobacco and the second adhesive are both positioned on the first side of the paper.

7. The article of claim 1, wherein the quantity of tobacco has a width that extends along the width of the paper, wherein the width of the quantity of tobacco is less than 1 inch, wherein the width of the paper is from 32 mm to 60 mm.

8. The article of claim 1, wherein the quantity of tobacco has a width between 10% and 50% of the width of the paper.

9. A cigarette comprising:

an article comprising:

a paper having a length, a width, first and second longitudinally extending edges spaced by the width, and first and second ends spaced by the length, wherein the length of the paper is greater than the width of the paper, wherein the paper comprises at least one of wood pulp, hemp, flax, rice, or straw;

a quantity of tobacco extending along an entirety of the length of the paper, wherein, in an unrolled configuration, the paper defines a surface area, wherein, in the unrolled configuration, the quantity of tobacco covers between 10% and 50% of the surface area of the paper, wherein the quantity of tobacco has a width that extends along the width of the paper, and wherein the quantity of tobacco comprises whole leaf tobacco;

a first adhesive that binds the quantity of tobacco to the paper; and a second adhesive that is configured to adhere a first portion of the paper to a second portion of the paper, wherein the article is formed in a roll and maintained in rolled form via the second adhesive with the quantity of tobacco disposed within the roll; and a smokable substance disposed within the roll.

10. The cigarette of claim 9, wherein the smokable substance comprises cannabis or a product extracted from a Cannabis plant.

11. The cigarette of claim 9, wherein the quantity of tobacco extends along only a portion of the width of the paper.

12. The cigarette of claim 9, wherein the width of the quantity of tobacco is between 10% and 50% of the width of the paper.

* * * * *